United States Patent [19]

Teter

[11] 4,122,727

[45] Oct. 31, 1978

[54] TOY SIDEWALK MECHANISM

[75] Inventor: Edward C. Teter, East Aurora, N.Y.

[73] Assignee: The Quaker Oats Company, Chicago, Ill.

[21] Appl. No.: 764,735

[22] Filed: Feb. 1, 1977

[51] Int. Cl.[2] ..... F16H 25/12; F16H 25/16; A63H 33/00

[52] U.S. Cl. ..... 74/56; 46/1 C

[58] Field of Search ..... 74/56; 46/1 C; 198/750, 198/752, 766

[56] References Cited

U.S. PATENT DOCUMENTS

| | | | |
|---|---|---|---|
| 504,912 | 9/1893 | Demonet | 74/56 |
| 2,328,270 | 8/1943 | Greenberg | 74/56 |
| 3,698,713 | 10/1972 | Jimerson | 46/1 C |

*Primary Examiner*—Samuel Scott
*Assistant Examiner*—James Yates
*Attorney, Agent, or Firm*—Cumpston & Shaw

[57] ABSTRACT

A drive mechanism for a toy or the like for imparting reciprocal movement to a driven member. In one toy application, the driven member comprises a sidewalk, and the drive mechanism imparts reciprocal movement to the sidewalk in either direction of movement of the drive mechanism. By designing the drive mechanism so that the sidewalk is moved in a forward direction at a slow rate of speed and in a reverse direction at a high rate of speed, it is possible to make objects such as toy people or animals advance in steps along the sidewalk.

2 Claims, 3 Drawing Figures

TOY SIDEWALK MECHANISM

BACKGROUND OF THE INVENTION

1. Field of the Invention

This invention relates generally to drive mechanisms for toys, and more specifically to a drive mechanism for a toy or the like for imparting reciprocal movement to a driven member.

2. Description of the Prior Art

It is known in the prior art to provide drive mechanisms for toys in which the drive mechanism is directly coupled to the driven mechanism. In such toys, movement of the drive mechanism in one direction will impart movement to the driven mechanism in the same direction. Movement of the drive mechanism in the opposite direction will impart movement to the driven mechanism in the opposite direction. Although such drive mechanisms operate satisfactorily for many applications, they are unsuitable for applications in which it is desired to impart reciprocal movement to a driven mechanism. One such application is a reciprocally movable toy sidewalk which when advanced in a forward direction at a slow rate of speed and retracted in the reverse direction at a high rate of speed is capable of advancing toy objects such as people or animals on the sidewalk in steps, simulating walking.

SUMMARY OF THE INVENTION

In accordance with a preferred embodiment of the invention, a drive mechanism for a toy or the like is disclosed for imparting reciprocal movement to a driven member. The drive mechanism comprises drive means movable in forward and reverse directions and comprising a plurality of saw-tooth drive cams arranged in succession and facing one direction. A reciprocally movable driven member is provided having resilient means for biasing the driven member toward the drive cams. Cam means are interposed between the drive cams and the driven member. The cam means comprises a unitary member having a plurality of first saw-tooth cams arranged in succession and facing the opposite direction and in mating engagement with the drive cams, and a plurality of second saw-tooth cams arranged in succession and facing the opposite direction as the drive cams and in engagement with the driven member. Movement of the drive means on one of the forward and reverse directions causes the drive cams to drive the first and second cams in the same direction causing the second cams to impart reciprocal movement to the driven member. Movement of the drive means in the other of the forward and reverse directions causes the second cams to initially engage opposite sides of the driven member for preventing movement of the cam means in the other direction, and then causes the drive cams to impart reciprocal movement to the cam means and driven member through the first driven cams.

In another aspect of the invention, the drive means is rotatable and has an annular member on which the drive saw-tooth cams are arranged in succession. The cam means comprises a rotatable and reciprocally movable sleeve having the first driven saw-tooth cams arranged in succession on one end thereof, and the second driven saw-tooth cams arranged in succession on the opposite end thereof.

In a more specific aspect of the invention, the drive mechanism comprises a drive crank rotatable about an axis in clockwise and counterclockwise directions. The drive crank has an annular member with axially extending endless saw-tooth drive cams rotatable with the drive member about the axis. The saw-tooth drive cams are arranged in succession facing one direction with each cam having an inclined rise surface and a sharp fall surface of shoulder. A platform is mounted for reciprocal movement substantially along the axis. Resilient means are provided for biasing the platform toward the first drive cams. A cam sleeve is rotatable about the axis and interposed between the drive cams and platform. The sleeve has first axially extending endless saw-tooth driven cams at one end similar in shape to the drive cams but facing in the opposite direction and mating with the drive cams. The sleeve has second axially extending endless saw-tooth driven cams at the opposite end in engagement with the platform and facing in the opposite direction from the drive cams. Each second cam has a flat valley surface, an inclined rise surface, and a sharp fall surface or shoulder.

The rise surfaces of the drive and second cams are the camming surfaces for moving the platform and an object such as a toy person or animal placed thereon together in a forward direction for transporting the object a finite distance to an advance position. The fall surfaces or shoulders of the drive and second saw-tooth cams, depending upon the direction of rotation of the crank, allow the platform to be rapidly returned by the resilient means in a reverse direction. The object, due to its inertia, remains substantially at the advance position during return movement of the platform. Accordingly, operation of the drive and second saw-tooth cams in succession upon rotation of the crank in either direction causes the object to advance in steps along the platform.

The invention and its advantages will become more apparent from the detailed description of the preferred embodiment presented below.

BRIEF DESCRIPTION OF THE DRAWING

In the detailed description of the preferred embodiment of the invention presented below, reference is made to the accompanying drawing, in which.

DESCRIPTION OF THE PREFERRED EMBODIMENT

Figure 1:
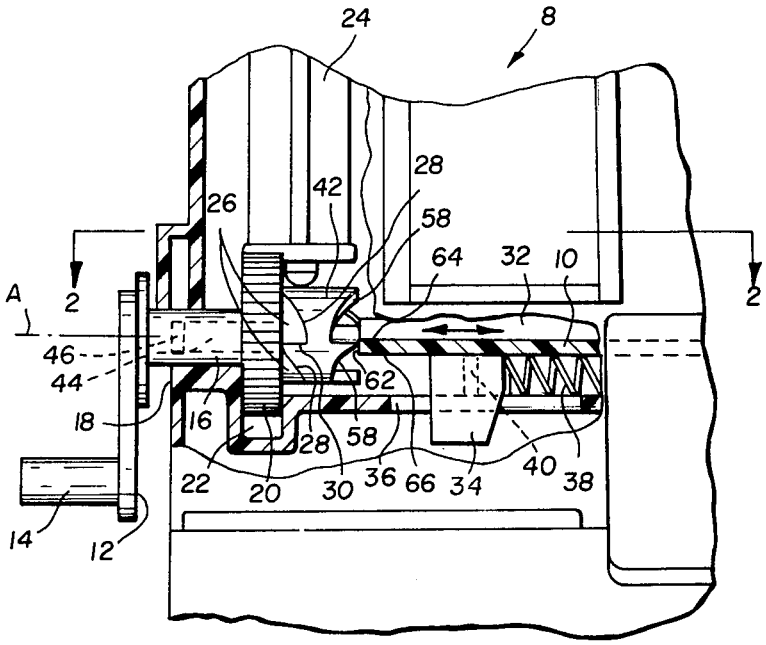
FIG. 1 is a segmental side elevational view partly in section of a preferred embodiment of the drive mechanism of this invention for imparting reciprocal movement to a toy sidewalk.

With reference to FIG. 1, a preferred embodiment of the drive mechanism of this invention is disclosed for a toy 8 or the like for imparting reciprocal movement to a driven member such as a sidewalk 10. This drive mechanism imparts reciprocal movement to sidewalk 10 in either direction of movement of the drive mechanism. The drive mechanism advances the sidewalk and any objects placed thereon such as toy persons or animals at a slow rate of speed to an advance position, and then allows retraction of the sidewalk alone at a high rate of speed while the objects due to this inertia remain substantially at their advance positions. Accordingly, upon reciprocal movement of the sidewalk, the toy objects advance along the sidewalk in steps until they fall off the forward end of the sidewalk into a slide chute, not shown, along which they slide to the ground level.

The drive mechanism has a drive means comprising a crank 12 having a handle 14 and a shaft 16 journaled for rotation in housing 18 of toy 8. Axial movement of crank 12 and shaft 16 is prevented by any suitable means such as a gear 20 secured to shaft 16 and rotatable within a close fitting notch 22 in housing 18. The gear 20 may be used to drive any other suitable toy structure such as a rotatable turret 24, shown in part.

The shaft 16 has on its free end a plurality of axially extending saw-tooth drive cams 26 arranged in succession on an annulus concentric with axis A of the shaft. Each drive cam 26 faces one direction and has an inclined rise surface 28 and a fall surface or shoulder 30.

The driven mechanism which is reciprocally driven by the drive means comprises a rectangular platform such as sidewalk 10 or the like. Sidewalk 10 is guided for reciprocal movement by any suitable means such as a U-shaped guide chute 32 rigidly secured to housing 18. Sidewalk 10 has a depending flange 34 adjacent its rear end extending through a slot 36 in chute 32 and engaging one end of a spring 38 interposed between spaced walls 40, only one of which is shown, depending from the base of chute 32. Spring 38 is compressed as sidewalk 10 is moved in a forward direction by the drive means at a slow rate of speed, and is then rapidly returned by spring 38 to its initial position. Accordingly, any toy object such as a person or animal placed on sidewalk 10 will move along with the sidewalk in the forward direction to an advance position and due to its inertia will remain at substantially the advance position as the sidewalk is rapidly moved in the reverse direction to its initial position. This action is similar in principle to the known amusement trick of jerking a table cloth off a table set with china without appreciably altering the position of the china on the table. This action in this toy can be enhanced by coating the surface of the sidewalk with a slippery material such as teflon.

Figure 3:
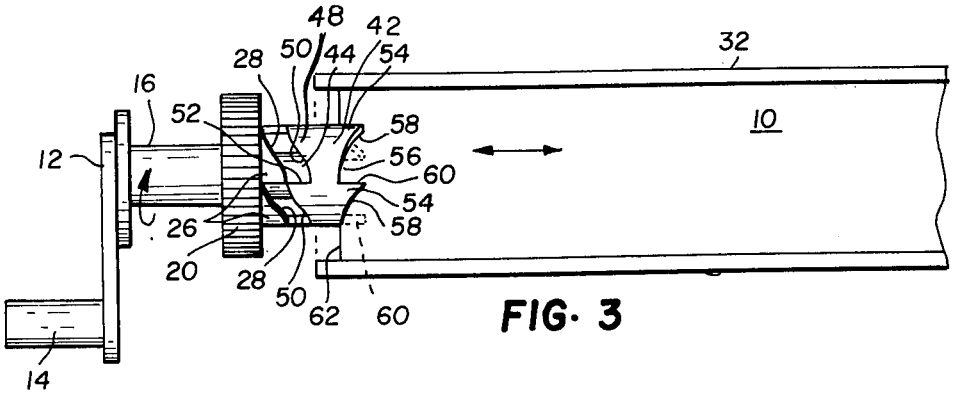
FIG. 3 is a top plan view similar to FIG. 2 showing how the parts of the drive mechanism interact when the drive mechanism is moved in a counter clockwise direction.

To achieve the reciprocal movement of sidewalk 10 at varying rates of speed in either direction of movement of the drive means, a driven cam means is interposed between drive cams 26 and sidewalk 10. The driven cam means comprises a cylindrical sleeve 42 having an axially extending stub shaft 44 journaled for rotation in a closed or blind bore 46 in drive shaft 16. One end of cylindrical sleeve 42 as best seen in FIG. 3 has a plurality of first axially extending saw-tooth driven cams 48. The first driven cams 48 are arranged in succession along the one end and are facing in the opposite direction of drive cams 26. Each first cam 48 has an inclined rise surface 50 and a sharp fall surface or shoulder 52 in mating engagement with a complementary drive cam 26. The opposite end of cylindrical sleeve 42 has a plurality of second axially extending saw-tooth driven cams 54 in engagement with the rear end of sidewalk 10. The second driven cams 54 are arranged in succession along the opposite end and are also facing in the opposite direction of drive cams 26. Each second driven cam 54 has a flat valley surface 56 an inclined rise surface 58 and sharp fall surface or shoulder 60. One end of sidewalk 10 extends across the diameter of second cams 54 and nests in valleys 56 of the cams.

Figure 2:
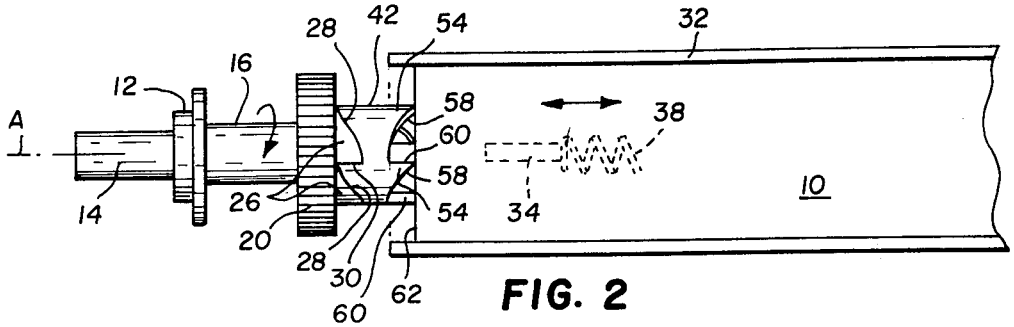
FIG. 2 is a top plan view of the drive mechanism of this invention taken substantially along line 2—2 with parts omitted for clarity and showing how the parts of the drive mechanism interact when the drive mechanism is moved in a clockwise direction.

With reference to FIGS. 1–3, the operation of the drive mechanism of this invention will now be described. When crank 12 is rotated in the clockwise direction as shown in FIG. 2, shoulders 30 of drive cams 26 drive the complementary shoulders 52 of the first driven cams 48 which are in mating engagement therewith. The inclined rise surfaces 58 of second driven cams 54 in engagement with end 62 of sidewalk 10 cams the sidewalk in a forward direction at a relatively low rate of speed. When sidewalk 10 slips off the crest of rise surface 58, spring 38 rapidly returns the sidewalk in the reverse direction along the fall or shoulder surfaces 60. Accordingly, any toy object such as a person on sidewalk 10 will advance with the sidewalk during its forward travel to an advance position and will substantially maintain that position as the sidewalk rapidly returns to its initial position.

Movement of drive crank 12 in the reverse direction as illustrated in FIG. 3 causes diametrically opposed fall surfaces or shoulders 60 of second driven cams 54 to engage the top and bottom sides 64, 66 respectively (FIG. 1) of sidewalk 10 preventing rotational movement of cam sleeve 42 in a reverse direction. The inclined rise surfaces 28 of drive cams 26 cam the mating rise surfaces 50 of first driven cams 48 for reciprocally moving cam sleeve 42 and sidewalk 10 as a unit in the same manner explained heretofore. Accordingly, operation of drive crank 12 in either direction of rotation will reciprocally move the sidewalk for advancing toy objects thereon in a step by step fashion.

The invention has been described in detail with particular reference to a preferred embodiment, but it will be understood that variations and modifications can be effected within the spirit and scope of the invention as described hereinabove. For example, instead of a rotatable crank and drive and driven cams arranged along an annulus for rotation, the drive means could be in the form of a slide having saw-tooth drive cams along one edge thereof. The driven cam means could also be in the form of a slide having first and second saw-tooth driven cams along opposite sides thereof with the first driven cams in mating engagement with the drive cams and the second driven cams in engagement with the end of the sidewalk.

What is claimed is:

1. A toy sidewalk mechanism for imparting reciprocal movement to the sidewalk for advancing toy objects placed thereon in steps, comprising:

a drive member rotatable about an axis in clockwise and counter-clockwise directions, said drive member having an axially extending annular member at one end thereof having first axially extending endless saw-tooth drive cams rotatable with said drive member about said axis;

a horizontal sidewalk for supporting toy objects placed thereof and reciprocally movable substantially along said axis, said sidewalk having a plate-like end portion;

resilient means for biasing said plate-like end portion of said sidewalk toward said drive cams; and a sleeve rotatable about said axis and interposed between said drive cams and said plate-like portion of said sidewalk, said sleeve having first axially extending endless saw-tooth driven cams at one end mating with said drive cams and second axially extending endless saw-tooth driven cams at the opposite end engaging said plate-like end portion, said drive, first and second saw-tooth cams each have an inclined rise surface for moving said sidewalk and objects together in a forward direction for transporting the objects finite distances to advance positions, and a fall surface for allowing said sidewalk to be rapidly returned by said resilient means in a reverse direction while the objects due to inertia remain substantially at said advance positions whereby rotation of said drive member in one of said clockwise and counter-clockwise directions causes said drive cams to rotatably drive said first driven cams and said sleeve in said one direction causing said second driven cams to reciprocally move said sidewalk causing the objects to advance in steps on said sidewalk, and rotation of said drive member in the other of said clockwise and counter-clockwise directions causes said fall surfaces of said second driven cams to engage opposite faces of said plate-like end portion of said sidewalk preventing rotation of said sleeve, and said drive cams to cam said first driven cams and said sleeve axially outwardly for reciprocally moving said sleeve and said sidewalk for also causing the objects to advance in steps on said sidewalk.

2. The toy mechanism of claim 1 wherein said drive member has a blind bore axially extending from said one end, and further has a crank at its opposite end, and said sleeve has an axially extending stub shaft slideably mounted in said bore for axially aligning said sleeve relative to said drive member.

* * * * *